United States Patent [19]

Tervamäki et al.

[11] 4,335,621

[45] Jun. 22, 1982

[54] PIPETTE

[75] Inventors: Jukka Tervamäki; Osmo Suovaniemi, both of Helsinki, Finland

[73] Assignee: kommandiittiyhtio Finnpipette Osmo A. Suovaniemi, Helsinki, Finland

[21] Appl. No.: 181,176

[22] Filed: Aug. 25, 1980

[30] Foreign Application Priority Data

Aug. 31, 1979 [FI] Finland ..... 792709

[51] Int. Cl.[3] ..... G01N 3/02

[52] U.S. Cl. ..... 73/863.32; 73/864.16; 222/391

[58] Field of Search ..... 73/863.32, 864.13, 864.16; 222/391

[56] References Cited

U.S. PATENT DOCUMENTS

| | | | |
|---|---|---|---|
| 1,718,596 | 6/1929 | Smith | 222/391 |
| 3,321,108 | 5/1967 | Bowe | 222/391 |
| 3,855,868 | 12/1974 | Suovaniemi | 73/863.32 |
| 4,099,548 | 7/1978 | Sturm et al. | 73/864.13 |

*Primary Examiner*—S. Clement Swisher

*Attorney, Agent, or Firm*—Hopgood, Calimafde, Kalil, Blaustein & Judlowe

[57] ABSTRACT

A pipette comprising a handle portion, whose upper end is provided with a press knob with shaft and inside which a piston rod is fitted. To the bottom end of the piston rod is connected a piston or, by the intermediate of a common actuating means of the pistons, several pistons and, for each piston, a cylinder part, which is fastened to the frame construction of the handle portion. The piston rod and the press knob shaft, which are parallel to each other, are placed at a distance from each other, and their surfaces facing each other are shaped as jointly operative with a cogwheel or friction wheel fitted between them and journalled on the handle portion by means of a shaft. Then, when the press knob is depressed, by the intermediate of the press knob shaft, of the cogwheel or friction wheel, and of the piston rod, the piston or the pistons in each cylinder portion can be shifted from the lower position into the upper position so as to suck liquid into the tip vessel connected to each cylinder portion. A freewheel is stationarily fitted inside the cogwheel or friction wheel, or a freewheel is fitted inside an operating means mounted on the shaft of the cogwheel or friction wheel, such as, for example, a dosage lever. The freewheel is coupled to its shaft in one direction so that, when the shaft is turned back and forth by means of the operating means, such as the dosage lever mounted on the shaft, repeated depressions of the operating means, such as the dosage lever, produce shifting of the piston rod stepwise downwards while the pivoting angle of the operating means, such as the dosage lever, determines the magnitude of the dose to be removed at a time from the tip vessel or tip vessels.

4 Claims, 8 Drawing Figures

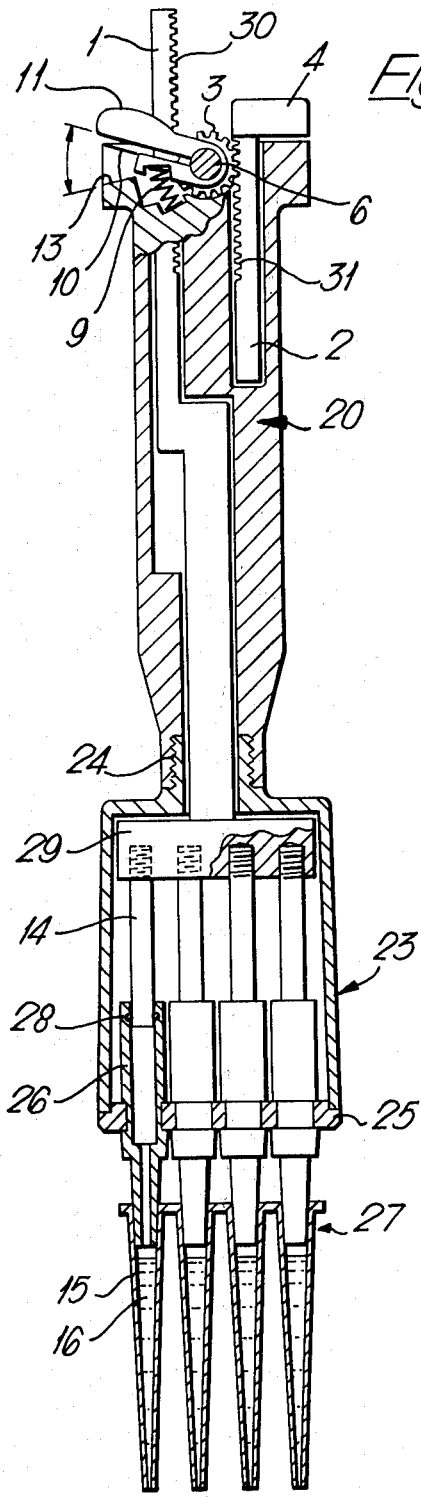
Fig. 1.
Fig. 2.
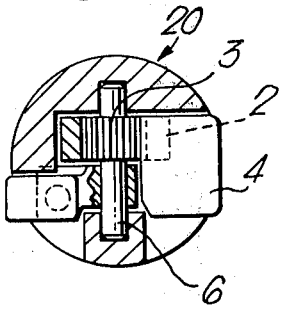

PIPETTE

The subject of the present invention is a pipette comprising a handle portion, whose upper end is provided with a press knob with shaft and inside which a piston rod is fitted and that to the bottom end of the piston rod is connected a piston or, by the intermediate of a common actuating means of the pistons, several pistons and, for each piston, a cylinder part, which is fastened to the frame construction of the handle portion, and that the piston rod and the press knob shaft, which are parallel to each other, are placed at a distance from each other, and their surfaces facing each other are shaped as jointly operative with a cogwheel or friction wheel fitted between them and journalled on the handle portion by means of a shaft, whereby, when the press knob is depressed, by the intermediate of the press knob shaft, of the cogwheel or friction wheel, and of the piston rod, the piston or the pistons in each cylinder portion can be shifted from the lower position into the upper position so as to suck liquid into the tip vessel connected to each cylinder portion.

Some pipettes of similar type are previously known, but they involve one or several of the following drawbacks:

the magnitude of the dose cannot be adjusted and/or calibrated, it is difficult to make the magnitude of the first dose equal to that of the following doses, the dosage mechanism of the pipette is not suitable for multi-channel series pipettes, but only for single-channel designs.

The multi-dose pipette in accordance with the present invention operates with the freewheel principle, and therein the magnitude of the dose can be readily adjusted and calibrated. Moreover, the first dose is automatically of the same magnitude as the following doses, and the freewheel mechanism and the general principle of the pipette is equally well suitable both for single-channel and multi-channel designs.

The pipette in accordance with the present invention is mainly characterized in that a freewheel is stationarily fitted inside the cogwheel or friction wheel, or a freewheel is fitted inside an operating means mounted on the shaft of the cogwheel (3) or friction wheel, such as, for example, a dosage lever, which freewheel is coupled to its shaft in one direction so that, when the shaft is turned back and forth by means of the operating means, such as the dosage lever mounted on the shaft, repeated depressions of the operating means, such as the dosage lever, produce shifting of the piston rod stepwise downwards while the pivoting angle of the operating means, such as the dosage lever, determines the magnitude of the dose to be removed at a time from the tip vessel or tip vessels.

Figure 3:
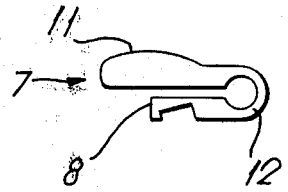
Figure 4:
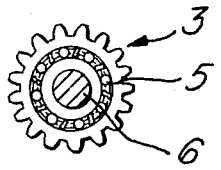
Figure 5:
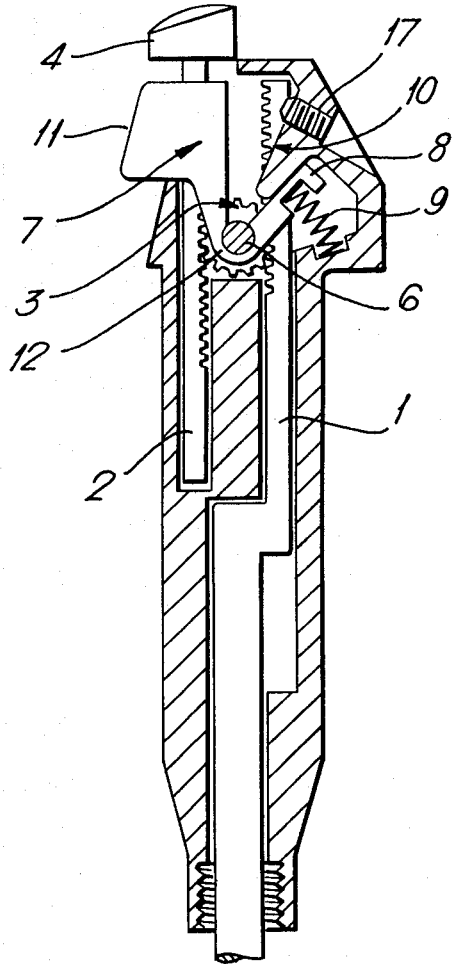
Figure 6:
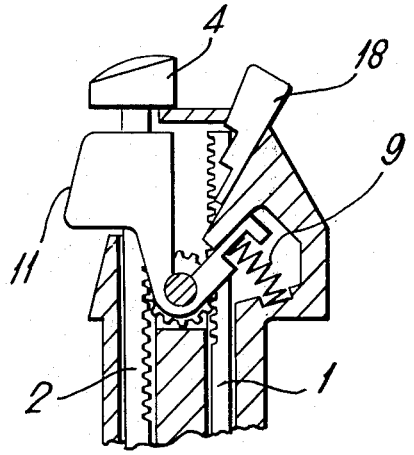
Figure 7:
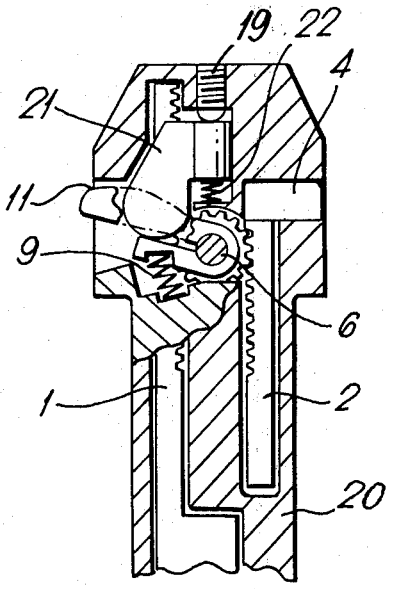
Figure 8:
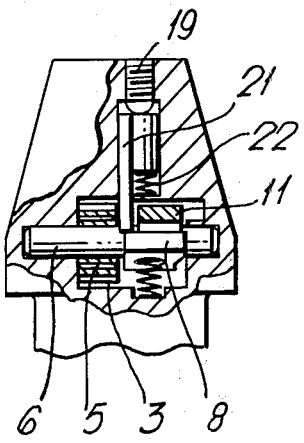

The invention comes out more closely from the following description and from the attached drawings, wherein FIG. 1 shows the pipette in accordance with the invention as a multi-channel embodiment as a side view and in section, FIG. 2 shows a section along line A—A in FIG. 1, FIG. 3 shows the dosage lever of FIG. 1 as separate, FIG. 4 is a side view of the cogwheel of the pipette shown in FIG. 1 as provided with a freewheel, FIG. 5 shows an embodiment alternative to the pipette shown in FIG. 1, FIG. 6 shows a constructional embodiment alternative to the pipettes shown in FIGS. 1 and 5, FIG. 7 shows an embodiment alternative to the constructional embodiments shown in FIGS. 1, 5 and 6, as a side view and in section, and FIG. 8 shows a section along the line B—B in FIG. 7.

FIG. 1 shows a four-channel pipette, which comprises a handle portion 20 and a frame casing 23, which are connected together by means of a threaded joint 24. To the disk 25 at the bottom part of the casing portion 23 are, side by side, attached the cylinder portions 26, whose outside faces become at the lower ends narrower conically downwards for the purpose of tight connecting of the tip vessels 15 of the disposable tip vessel element 27 to the cylinder portions 26. O-ring seals 28 are fitted into the grooves at the upper ends of the cylinder portions 26 between the piston 14 and the cylinder. The pistons 4 are at their upper ends connected to their common actuating means 29 of the pistons. A piston rod 1 projects from the actuating means 29 of the pistons into the handle portion 20. As is shown in FIG. 1, the handle portion 20 is also provided with a press knob 4 with shaft 2 so that the piston rod 1 and the press knob 4 shaft 2, which are parallel to each other, are placed at a distance from each other. The upper part of the piston rod 1 and the press knob 4 shaft 2 have, for example, a square cross-sectional form. The surfaces of the piston rod 1 and of the press knob 4 shaft 2 facing each other are shaped into rack bar portions 30 and 31, between which a cogwheel 3 fastened to the handle portion 20 and jointly operative with said rack bar portions is fitted. In stead of rack bar portions 30 and 31, the faces concerned may also be plane friction faces, in which case the cogwheel 3 is correspondingly substituted by a friction wheel. When the press knob 4 shaft 2 is depressed, the piston rod 1 rises the corresponding distance upwards.

Inside the cogwheel 3 a freewheel 5 has been constructed, which is further fitted on a shaft 6 so that the shaft may rotate freely inside the freewheel 5 and the cogwheel 3 in one direction but is engaged and drives the cogwheel 3 when the shaft 6 is turned in the opposite direction. In FIG. 4 the cogwheel 3, the freewheel 5 and the shaft 6 are seen as enlarged and as disassembled. On the shaft 6, alongside the cogwheel 3, a U-shaped dosage lever 7 is mounted additionally, whose lower part 8 is pressed by a spring 9 against a limiter 10. In FIG. 3 the dosage lever 7 is shown as separate. A construction functionally similar to the above is obtained by placing the freewheel inside the dosage lever 7 and the cogwheel 3 or friction wheel stationarily on the shaft 6.

The pipette in accordance with FIG. 1 operates as follows.

When the press knob 4 is depressed, the press knob shaft 2 moves downwards and then the rack bar portion 31 on the shaft 2 rotates the cogwheel 3. The cogwheel 3 in its turn transfers the movement to the rack bar portion 30, whereby the piston rod 1 rises. In FIG. 1 the press knob 4 is in the depressed position and the piston rod 1 in the upper position. When the piston rod 1 rises, it moves along with it, by the intermediate of the actuating means 29 of the pistons, correspondingly, the pistons 14, whereby a suction is produced into the cylinder portions 26 and liquid can then be sucked into the tip vessels 15 if their tips have been submerged into a basin containing liquid.

When the dosage lever 7 is hereinafter depressed by the finger by means of the knob 11, the lower part 8 of the dosage lever 7 detaches itself from the limiter 10, whereby the spring 9 presses the thinner portion 12 on the shaft 6 of the lever 7 more tightly around the shaft 6. In this way, when the knob 11 is depressed, the dosage lever 7 engages and disengages the shaft 6, and starts rotating the shaft 6 when the knob 11 is further depressed, until the knob 11 reaches the lower limiter 13. When the shaft 6 rotates during depression of the knob 11, the freewheel 5 is engaged with the shaft 6 and at the same time rotates the cogwheel 3, which further shifts the rack bar portions 1 and 2 the step corresponding the depression of the knob 11.

The rack bar portion 1, which is still firmly connected to the pistons 14 of the pipette 20, also moves the pistons 14 the corresponding distance down when the knob 11 is depressed. Then, liquid 16 is removed from the disposable tip vessel 15 of the pipette corresponding the step of the pistons 14. When the knob 11 is allowed to rise back towards the upper position, the shaft 6 rotates along with the lever 7. The freewheel 5 and the cogwheel 3 do, however, not rotate along with the shaft 6, because the movement takes place in the direction of release of the freewheel 5. Under these circumstances, the pistons 14 do not move when the knob 11 moves upwards.

The back and forth movement of the knob 11 can be repeated several times subsequently, whereby a stepwise downward movement of the pistons 14 is produced and, correspondingly, liquid 16 is removed out of the disposable tip vessels 15 as precisely equal quantities.

When the disposable tip vessels 15 are supposed to be refilled with liquid, the knob 4 is depressed, whereby the pistons 14 rise upwards by the intermediate of the cogwheel 3 and the piston rod 1. The cogwheel 3 also rotates the freewheel 5 and the shaft 6, but since the spring 9 presses the lower part 8 of the dosage lever 7 against the limiter 10, the thinner portion 12 of the dosage lever 7 is not pressed around the shaft 6 but allows the shaft 6 to rotate freely inside the lever 7. In this way the dosage lever 7 does not cause friction during the movement of filling of the vessels 15.

Of course, the multi-step pipette suggested here may have several embodiments mainly in respect of the positioning and the direction of movement of the cogwheel 3, freewheel 5, lever 7, etc. components, but they do not change the principle of operation of the invention, which is based on the freewheel 5 and on the thinner portion 12 of the lever 7, which is, by the intermediate of the spring 9, tightened and engages the shaft 6. FIG. 5 shows another possible embodiment of the pipette, wherein the direction of movement of the knob 11 differs from that described above. In this embodiment the limiter of the movement of the knob 11 consists of the screw 17, by means of which the liquid quantity to be dosed can be calibrated or adjusted. In the place of the screw 17, there may also be a limiter disk, a slide, or an adjusting plate 18, as is shown in FIG. 6.

Adjustment or calibration of the dose quantity may also be achieved by adjusting the upper limiter 10 of the movement of the lower part 8 of the lever 7. This mode of adjustment is illustrated in one of its embodiments in FIGS. 7 and 8.

A screw 19 is mounted at the upper end of the handle 20 of the pipette, which screw presses the limiter disk or limiter block 21 down. The spring 22 presses the limiter block 21 upwards against the screw 19, so that it is possible to make the limiter block 21 more precisely in the up-and-down direction by turning the screw 19. The lower part 8 of the lever 7, in its turn, rests against the limiter block 21, so that the upper position of the lever 7 is determined by turning the screw 19.

What we claim is:

1. A pipette comprising a handle portion, whose upper end is provided with a press knob with a shaft and inside which a piston rod is fitted and to the bottom end of the piston rod is connected at least one piston and, for each piston, a cylinder part, which is fastened to the frame construction of the handle portion, and the piston rod and the press knob shaft, which are parallel to each other, are placed at a distance from each other, and their surfaces facing each other are shaped as jointly operative with a movement transfer wheel fitted between them and journalled on the handle portion by means of a shaft, whereby, when the press knob is depressed, by the intermediate of the press knob shaft, of the movement transfer wheel, and of the piston rod, the piston in each cylinder portion can be shifted from the lower position into the upper position so as to suck liquid into the tip vessel connected to each cylinder portion, characterized in that a freewheel is fitted inside at least one of the movement transfer wheel and an operating means mounted on the shaft of the movement transfer wheel which freewheel is coupled to its shaft in one direction so that, when the shaft is turned back and forth by means of the operating means mounted on the shaft, repeated depressions of the operating means produce shifting of the piston rod stepwise downwards while the pivoting angle of the operating means determines the magnitude of the dose to be removed at a time from at least one tip vessel.

2. The pipette of claim 1 wherein the operating means turning the shaft of the movement transfer wheel is a dosage lever mounted on the shaft, which lever is arranged so that, when the lever is depressed, the lever grasps at least one of the shaft and the freewheel placed around the shaft with compression friction force, and which lever, in its upper position, permits the shaft to rotate freely in relation to the dosage lever.

3. The pipette of claims 1 or 2 wherein the positions of the limiters determining at least one extreme position of the track of back and forth movement of the dosage lever are arranged as continuously adjustable by means of a screw so as to adjust and/or calibrate the dosage volume.

4. The pipette of claims 1 or 2 wherein the limiter determining one extreme position of the track of back and forth movement of the dosage lever comprises at least one of a turnable and a movable limiter material which is at least one of a disk, slide and plate, which includes at least one of steps and pins of different heights so as to select the position of the limiter, and thereby the dosage volume, stepwise as desired.

* * * * *